US008851304B2

(12) United States Patent
Alexander

(10) Patent No.: US 8,851,304 B2
(45) Date of Patent: Oct. 7, 2014

(54) HAIR IRON HOLDER

(76) Inventor: Richard Michael Alexander, Everett, WA (US)

( * ) Notice: Subject to any disclaimer, the term of this patent is extended or adjusted under 35 U.S.C. 154(b) by 0 days.

(21) Appl. No.: 13/452,739

(22) Filed: Apr. 20, 2012

(65) Prior Publication Data

US 2013/0015149 A1 Jan. 17, 2013

Related U.S. Application Data

(60) Provisional application No. 61/506,345, filed on Jul. 11, 2011.

(51) Int. Cl.
*A47B 81/00* (2006.01)
*A45D 1/00* (2006.01)

(52) U.S. Cl.
CPC ..... *A45D 1/00* (2013.01); *A45D 2001/002* (2013.01)
USPC ..... 211/60.1; 211/87.01

(58) Field of Classification Search
CPC ..... A45D 1/00; A45D 2001/002; A45D 2006/005; A45D 20/00; A45D 20/12; A45D 20/14; A47F 7/0028; D06F 79/02; B23K 3/027
USPC ..... 211/60.1, 63, 70.1, 70.7, 119.009, 70.6, 211/87.01, 70.8; 248/117.1, 117.2, 117.7, 248/117.3, 117.4, 117.5, 220.21, 311.2; 206/372, 373, 374, 375
See application file for complete search history.

(56) References Cited

U.S. PATENT DOCUMENTS

| | | | | | |
|---|---|---|---|---|---|
| 3,327,981 | A | * | 6/1967 | Yates | 248/117.2 |
| 3,342,343 | A | * | 9/1967 | Youlden | 211/88.01 |
| D243,559 | S | * | 3/1977 | Hoyle et al. | D28/38 |
| 4,103,145 | A | * | 7/1978 | Oliveri | 219/222 |
| 4,159,773 | A | * | 7/1979 | Losenno | 211/70.6 |
| 4,225,106 | A | * | 9/1980 | Eplan | 248/282.1 |
| 4,446,972 | A | * | 5/1984 | Sussman | 211/26 |
| 4,673,148 | A | * | 6/1987 | Oliver | 248/292.14 |
| D305,944 | S | * | 2/1990 | Mellott | D28/38 |
| 4,973,019 | A | * | 11/1990 | Baird et al. | 248/314 |
| D314,067 | S | * | 1/1991 | Ward | D28/38 |
| 5,005,711 | A | * | 4/1991 | Peatross et al. | 211/70.7 |
| 5,054,615 | A | * | 10/1991 | Stillwagon et al. | 206/373 |
| D342,585 | S | * | 12/1993 | Fischbach et al. | D28/38 |
| D346,243 | S | * | 4/1994 | Weber | D28/38 |
| 5,558,236 | A | * | 9/1996 | Williams et al. | 211/74 |
| 5,584,403 | A | * | 12/1996 | Sipperly | 211/63 |
| D379,554 | S | * | 5/1997 | Landers | D28/35 |
| 5,661,910 | A | * | 9/1997 | Schepisi | 34/97 |
| 5,727,701 | A | * | 3/1998 | Rhoades | 211/70.6 |
| 5,730,513 | A | * | 3/1998 | Lemon et al. | 312/238 |
| 5,743,415 | A | * | 4/1998 | Smart | 211/70.6 |
| 5,749,379 | A | * | 5/1998 | Stillwagon et al. | 132/200 |
| D401,016 | S | * | 11/1998 | Holliday | D28/73 |

(Continued)

*Primary Examiner* — Jonathan Liu
*Assistant Examiner* — Stanton L Krycinski
(74) *Attorney, Agent, or Firm* — The Law Office of Patrick F. O'Reilly III, LLC

(57) ABSTRACT

A hair iron holder is configured to provide protection from incidental contact to users while holding a heated iron. A barrel for detaining irons may include a side wall with vent holes to dissipate heat. The holder may also prevent damage to hair irons as they are inserted into the holder. An open end of the barrel may include a rounded flange preventing scratching of irons during insertion.

16 Claims, 5 Drawing Sheets

(56) References Cited

U.S. PATENT DOCUMENTS

| | | | | | |
|---|---|---|---|---|---|
| 6,038,782 | A * | 3/2000 | Schepisi | 34/97 |
| 6,123,299 | A * | 9/2000 | Zach, Sr. | 248/117.1 |
| 6,209,732 | B1 * | 4/2001 | Dennis et al. | 211/70.6 |
| D469,926 | S * | 2/2003 | Petruccelli | D28/73 |
| 6,601,813 | B1 * | 8/2003 | Kager et al. | 248/314 |
| D487,170 | S * | 2/2004 | Petruccelli | D28/73 |
| 6,820,755 | B1 * | 11/2004 | Ranjit | 211/70.6 |
| D552,796 | S * | 10/2007 | Petruccelli | D28/73 |
| D603,095 | S * | 10/2009 | Petruccelli | D28/38 |
| 7,748,583 | B1 * | 7/2010 | Woltman | 224/251 |
| 7,784,750 | B2 * | 8/2010 | Burk | 248/176.2 |
| 2007/0245590 | A1 * | 10/2007 | Burk | 34/283 |
| 2009/0065661 | A1 * | 3/2009 | Burk | 248/146 |
| 2011/0133572 | A1 * | 6/2011 | Levi | 307/139 |
| 2012/0324755 | A1 * | 12/2012 | Zhao | 34/427 |
| 2013/0119003 | A1 * | 5/2013 | Paga et al. | 211/65 |

* cited by examiner

HAIR IRON HOLDER

CROSS-REFERENCE TO RELATED APPLICATION

This application claims benefit under 35 U.S.C. §119(e) of U.S. Provisional Application No. 61/506,345 filed Jul. 11, 2011, which is hereby incorporated by reference herein in its entirety.

BACKGROUND OF THE INVENTION

The present invention generally relates to receptacles, and more particularly, to a hair iron holder.

Hair irons, for example, hot irons, crimping irons, or curling irons operate by typically heating an elongated barrel for direct contact with hair. The heated barrel is typically coupled to a clamp where the hair is disposed between the barrel and clamp when heated. The clamp is typically disposed over one side of the barrel leaving the other side of the barrel exposed. When not in use, it may be common for a user to lay the hair iron down on a counter top. An unattended hair iron can easily come into skin contact with a distracted person or a child unaware that the barrel is hot.

As can be seen, there is a need for an apparatus that can safely detain a hair iron while heated.

SUMMARY OF THE INVENTION

In one aspect of the present invention, a hair iron holder comprises a barrel; a rounded flange on an open end of the barrel; and a wall mount coupled to the barrel.

In another aspect of the present invention, a hair iron holder comprises a first barrel and a second barrel coupled in juxtaposition by a mounting flange disposed between the first and second barrel, wherein the first barrel includes an inner diameter greater than an inner diameter of the second barrel; a rounded flange on an open end of the first and second barrels; side walls on the first and second barrels, the side walls including vent holes; and a wall mount coupled to the mounting flange.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claim.

Broadly, an embodiment of the present invention generally provides an apparatus to hold hair irons while heated that can protect inattentive persons from accidently touching a heated iron. Aspects of the hair iron holder may conduct heat away from the hair iron and dissipate heat into environment.

Figure 1:
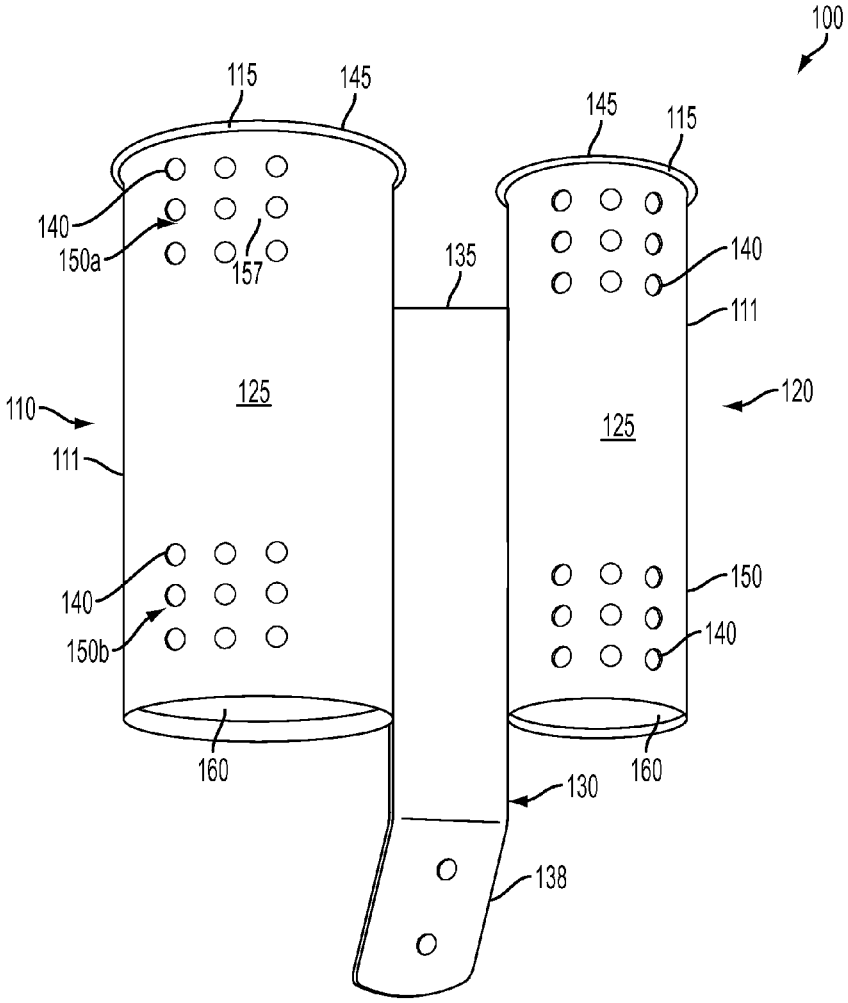
FIG. 1 shows a front view of a hair iron holder according to an exemplary embodiment of the invention.
Figure 2:
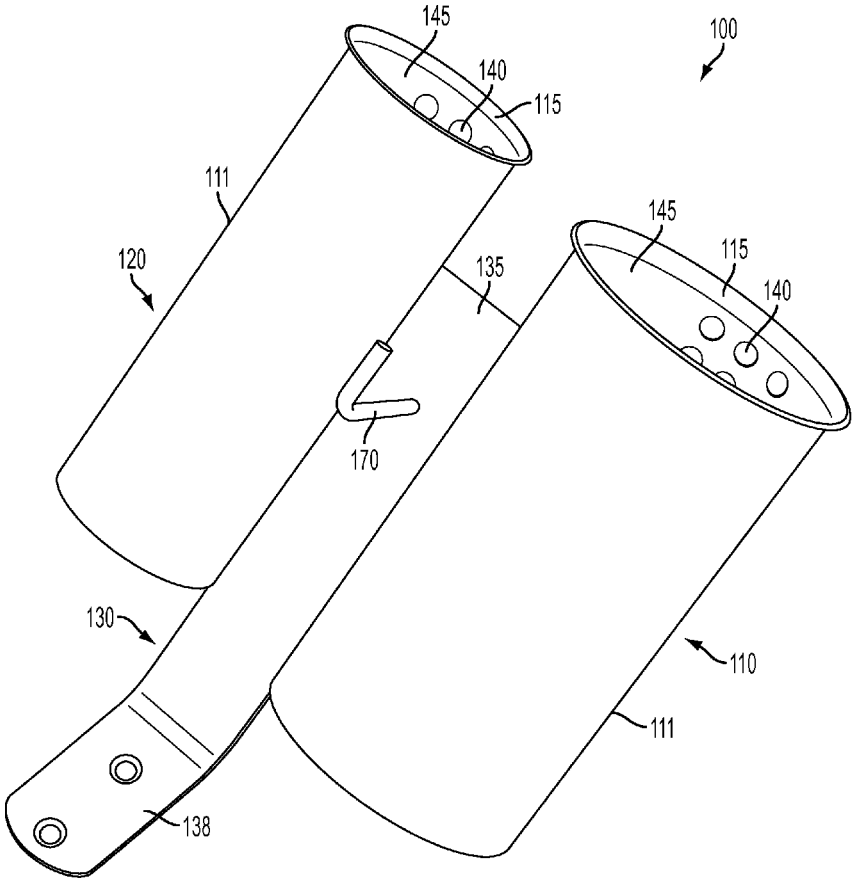
FIG. 2 shows a perspective rear view of the hair iron holder of FIG. 1.
Figure 3:
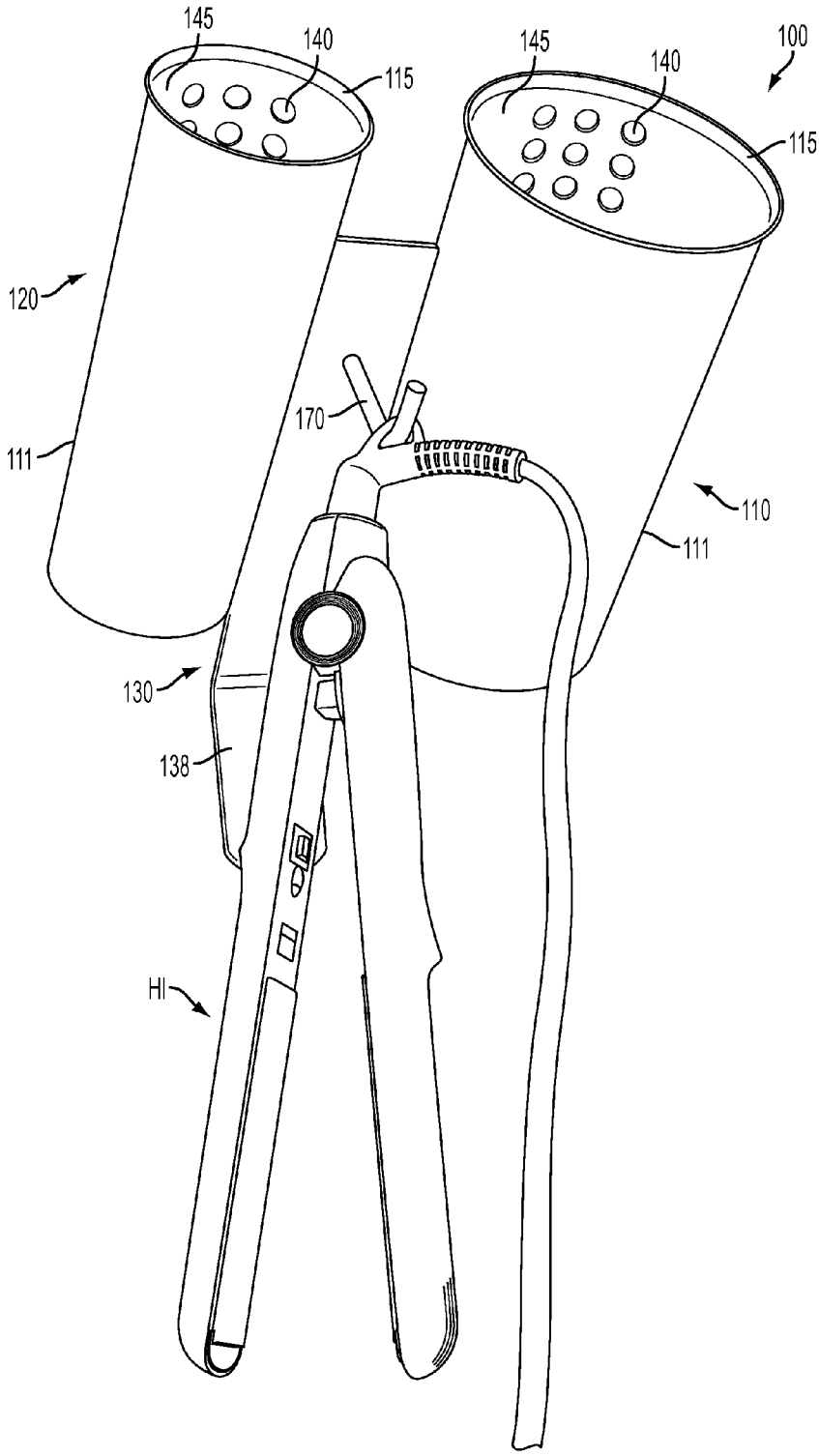
FIG. 3 shows the perspective rear view of the hair iron holder of FIG. 2 with a hair iron hung onto a hook of the hair iron.

Referring now to FIGS. 1-3, an exemplary embodiment of a hair iron holder 100 is shown. The hair iron holder 100 may hold for example, curling irons, flat irons, or crimping irons. In one exemplary embodiment, a dual barreled hair iron holder 100 is shown. The first barrel 110 may have an inner diameter that is greater than an inner diameter of the second barrel 120. Thus, in one aspect, the hair iron holder 100 can hold, for example, a flat iron (not shown) in the first barrel 110 and a thinner curling iron (not shown) in a second barrel 120.

The first barrel 110 and second barrel 120 may be coupled together in juxtaposition by a mounting flange 135 of a wall mount 130. The mounting flange 135 may be between the first barrel 110 and second barrel 120. The wall mount 130 may include an angled brace 138 configured to permit the first barrel 110 and second barrel 120 to project outward and tilted away from its mounting surface. A hook 170 may project outward from the mounting flange 135. The hook 170 may be configured to carry, for example, a hair iron HI while the hair iron is being used, for quick access of use by the user.

For sake of illustration, reference to elements in the first barrel 110 will be understood to include like elements in the second barrel 120. Accordingly, the remaining description will be described in the context of the first barrel 110.

In one aspect, the barrel 110 may be configured to dissipate heat from a detained hair iron (not shown) so that a person touching the hair iron holder 100 is protected from burns. The barrel 110 may include a stainless steel body 111. The body 111 may include a side wall 125 including vent holes 140. The vent holes 140 maybe arranged in an array 150. In an exemplary embodiment, the side wall 125 may include an upper section 157 and a lower section 155 where respective arrays 150*a* and 150*b* are positioned. A bottom floor 160 of the barrel 110 may be opposite an open end 145. The bottom floor 160 may also include vent holes 140. When a heated hair iron is inserted into the barrel 110, the stainless steel body 111 may act as a heat sink drawing heat away from hair iron. As heat is distributed around the barrel 110, the vent holes 140 may help draw heat out of the barrel 110 and into the surround air.

In another aspect, the barrel 110 may help protect hair irons from being damaged when detained. For example, the barrel 110 may include a rounded flange 115 on the open end 145. The rounded flange 115 may be a polished lip projecting outward from the open end 145. As hair irons are inserted into the barrel 110, the sides of the irons may engage the smooth lip thus, preventing scratching of the hair irons.

Figure 4:
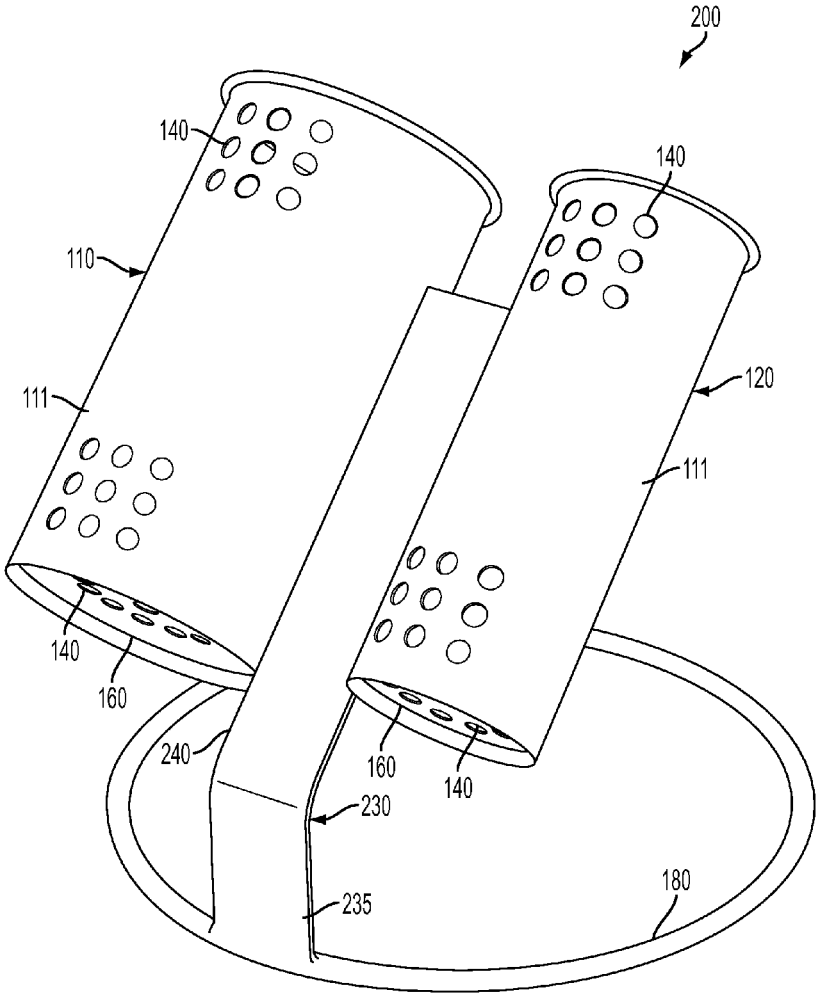
FIG. 4 shows a front perspective view of a hair iron holder according to another exemplary embodiment of the invention.
Figure 5:
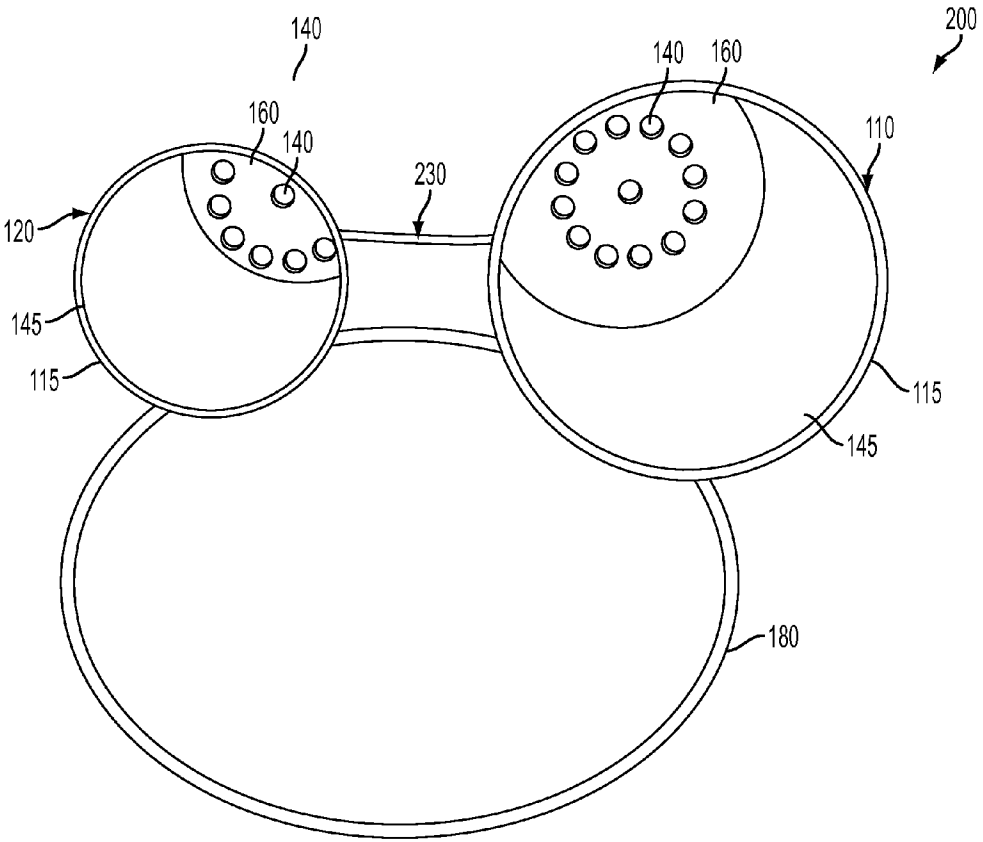
FIG. 5 shows a top view of the hair iron holder of FIG. 4.

Referring now to FIGS. 4 and 5, a hair iron holder 200 is shown. The hair iron 200 is similar to the hair iron holder 100 except that instead of being configured for wall mounting, a stand 180 is connected to the barrels 110 and 120 so that the hair iron holder 200 may rest atop a horizontal surface, for example, a countertop. A flange 230 may be connected between the barrels 110 and 120. A bent portion 235 of the flange may angle away from a flange main portion 240 bridging the stand 180 to the flange main portion. The stand 180 may be attached to the bent portion 235 so that the barrels 110 and 120 project upward at an obtuse angle from a horizontal surface (not shown). In some exemplary embodiments, the stand 180 may be circular so that it may rest planar to the horizontal surface (not shown) it sits stop. During use, a hair iron (not shown) may be inserted at an angle into either of the barrels 110 or 120 maximizing line of sight of the user with entry into the barrel and minimizing contact along a barrel edge.

It should be understood, of course, that the foregoing relates to exemplary embodiments of the invention and that modifications may be made without departing from the spirit and scope of the invention as set forth in the following claim.

What is claimed is:

1. A hair iron holder, comprising:

a barrel having an open end and a closed end, the barrel including a curved side wall and a bottom floor, the bottom floor positioned at the closed end of the barrel opposite to the open end thereof, wherein the curved side wall of the barrel includes at least one plurality of vent holes, and wherein the at least one plurality of vent holes comprises two spaced apart pluralities of vent holes, a first of the two spaced apart pluralities of vent holes being disposed in a lower section of the curved side wall, a second of the two spaced apart pluralities of vent holes being disposed in an upper section of the curved side wall that is axially spaced apart from the lower section of the curved side wall, each of the two spaced apart pluralities of vent holes including vent holes arranged in an array having multiple rows and columns, the vent holes being arranged generally linearly in the rows and columns on a back curved surface of the curved side wall of the barrel, and wherein a front curved surface of the curved side wall of the barrel is completely solid throughout the length thereof;

a rounded flange on the open end of the barrel; and a wall mount coupled to the barrel, the wall mount including a mounting flange extending radially outward from the curved side wall of the barrel, the mounting flange being in the form of a generally linear member, the mounting flange extending along a length of the barrel to a first predetermined distance beneath the closed end of the barrel, the mounting flange further including a top edge spaced apart from the rounded flange on the open end of the barrel by a second predetermined distance.

2. The hair iron holder of claim 1, wherein the wall mount further comprises an angled brace connected to a lower end of the mounting flange, and beneath the closed end of the barrel, the angled brace disposed at an obtuse angle relative to the mounting flange, and the angled brace including a plurality of mounting holes disposed therethrough for securing the hair iron holder to a mounting surface.

3. The hair iron holder of claim 2, wherein the bottom floor comprises a perforated plate having a plurality of vent holes arranged in a generally symmetrical pattern, the bottom floor of the barrel being recessed with respect to a lower edge of the curved side wall of the barrel.

4. A hair iron holder, comprising:

a first barrel and a second barrel, each of the first and second barrels having a respective open end and a respective closed end, each of the first and second barrels further including a respective curved side wall and a respective bottom floor, the respective bottom floor of each of the first and second barrels positioned at the respective closed end thereof and opposite to the respective open end thereof, wherein the first barrel includes an inner diameter greater than an inner diameter of the second barrel;

a rounded flange on the respective open end of each of the first and second barrels;

vent holes disposed in the respective curved side walls of each of the first and second barrels, wherein the vent holes disposed in the respective curved side walls of each of the first and second barrels are arranged in respective spaced apart arrays, a first of the respective spaced apart arrays of vent holes being disposed in respective lower sections of the respective curved side walls, a second of the respective spaced apart arrays of vent holes being disposed in respective upper sections of the curved side walls that are axially spaced apart from the respective lower sections of the curved side walls, each of the respective spaced apart arrays of vent holes having vent holes arranged in multiple rows and columns, the vent holes being arranged generally linearly in the rows and columns on a back curved surface of each of the curved side walls of the first and second barrels, and wherein a front curved surface of each of the curved side walls of the first and second barrels is completely solid throughout the length thereof; and a wall mount coupled to the first barrel and the second barrel, the wall mount including a mounting flange disposed between the first and second barrels and coupling the first barrel and the second barrel together in juxtaposition, the mounting flange extending radially outward from the respective curved side wall of the first barrel and radially inward towards the respective curved side wall of the second barrel, the mounting flange being in the form of a generally linear member, the mounting flange extending along a length of each of the first and second barrels to a first predetermined distance beneath the respective closed ends of the first and second barrels, the mounting flange further including a top edge spaced apart from the rounded flanges of the first and second barrels by a second predetermined distance.

5. The hair iron holder of claim 4, wherein the wall mount further comprises an angled brace connected to a lower end of the mounting flange, and beneath the respective closed ends of the first and second barrels, the angled brace disposed at an obtuse angle relative to the mounting flange, and the angled brace including a plurality of mounting holes disposed therethrough for securing the hair iron holder to a mounting surface.

6. The hair iron holder of claim 4, wherein the respective bottom floor of each of the first and second barrels comprises a perforated plate having a plurality of vent holes arranged in a generally symmetrical pattern, the respective bottom floor of each of the first and second barrels being recessed with respect to a lower edge of the curved side wall of the respective barrel.

7. The hair iron holder of claim 4, wherein at least one of the first and second barrels is made from stainless steel.

8. The hair iron holder of claim 4, wherein each of the first and second barrels are mounted in a cantilevered manner from the mounting flange of the wall mount.

9. A hair iron holder, comprising:

a first barrel and a second barrel, each of the first and second barrels having a respective open end and a respective closed end, each of the first and second barrels further including a respective curved side wall and a respective bottom floor, the respective bottom floor of each of the first and second barrels positioned at the respective closed end thereof and opposite to the respective open end thereof, wherein the first barrel includes an inner diameter greater than an inner diameter of the second barrel;

a rounded flange on the respective open end of each of the first and second barrels;

vent holes disposed in the respective curved side walls of each of the first and second barrels, wherein the vent holes disposed in the respective curved side walls of each of the first and second barrels are arranged in respective spaced apart arrays, a first of the respective spaced apart arrays of vent holes being disposed in respective lower sections of the respective curved side walls, a second of the respective spaced apart arrays of vent holes being disposed in respective upper sections of the curved side walls that are axially spaced apart from the respective lower sections of the curved side walls, each of the respective spaced apart arrays of vent holes having vent holes arranged in multiple rows and columns, the vent holes being arranged generally linearly in the rows and columns on a back curved surface of each of the curved side walls of the first and second barrels, and wherein a front curved surface of each of the curved side walls of the first and second barrels is completely solid throughout the length thereof; and a mounting assembly coupled to the first barrel and the second barrel, the mounting assembly including a mounting flange disposed between the first and second barrels and coupling the first barrel and the second barrel together in juxtaposition, the mounting flange extending in opposed radial directions from the respective curved side walls of the first and second barrels, the mounting flange being in the form of a generally linear member, the mounting flange extending along a length of each of the first and second barrels to a first predetermined distance beneath the respective closed ends of the first and second barrels, the mounting flange further including a top edge spaced apart from the rounded flanges of the first and second barrels by a second predetermined distance.

10. The hair iron holder of claim 9, wherein the mounting assembly further comprises an angled brace connected to a lower end of the mounting flange, and beneath the respective closed ends of the first and second barrels, the angled brace disposed at an obtuse angle relative to the mounting flange, and the angled brace including a plurality of mounting holes disposed therethrough for securing the hair iron holder to a mounting surface.

11. The hair iron holder of claim 9, wherein the respective bottom floor of each of the first and second barrels comprises a perforated plate having a plurality of vent holes arranged in a generally symmetrical pattern, the respective bottom floor of each of the first and second barrels being recessed with respect to a lower edge of the curved side wall of the respective barrel.

12. The hair iron holder of claim 11, wherein the bottom floor of the first barrel includes a solid annular peripheral portion circumscribing a perforated circular interior portion, the perforated circular interior portion of the bottom floor having the plurality of vent holes arranged in the generally symmetrical pattern, the generally symmetrical pattern being a generally symmetrical circular pattern.

13. The hair iron holder of claim 9, wherein each of the first and second barrels are mounted in a cantilevered manner from the mounting flange of the mounting assembly.

14. The hair iron holder of claim 9, wherein the mounting assembly further comprises a bent portion connected to a lower end of the mounting flange, and beneath the respective closed ends of the first and second barrels, the bent portion disposed at an obtuse angle relative to the mounting flange; and wherein the hair iron holder further comprises a circular base portion connected to a lower end of the bent portion, the circular base portion configured to rest on top of a horizontal surface, the circular base portion being in the form of an annular member.

15. The hair iron holder of claim 4, wherein the mounting flange includes a hook member projecting outwardly therefrom.

16. The hair iron holder of claim 9, wherein the mounting flange includes a hook member projecting outwardly therefrom.

* * * * *